United States Patent [19]

Colletti

[11] Patent Number: 4,830,185

[45] Date of Patent: May 16, 1989

[54] DINNERWARE CARTON

[75] Inventor: Peter Colletti, Prospect Heights, Ill.

[73] Assignee: Johann Haviland China, Des Plaines, Ill.

[21] Appl. No.: 83,243

[22] Filed: Aug. 10, 1987

[51] Int. Cl.[4] ..... B65D 85/44

[52] U.S. Cl. ..... 206/449; 206/526; 229/164

[58] Field of Search ..... 206/326, 476, 449, 526, 206/585, 424; 229/150, 155, 164, 16 R, 158

[56] References Cited

U.S. PATENT DOCUMENTS

| | | | |
|---|---|---|---|
| 1,829,005 | 10/1931 | Kalnitz | 229/158 |
| 2,791,363 | 5/1957 | Boeye | 229/16 R |
| 2,844,295 | 7/1958 | Williams | 206/326 |
| 3,027,061 | 3/1962 | Locke | 229/16 R |
| 3,346,399 | 10/1967 | Watson et al. | 229/158 |
| 3,352,053 | 11/1967 | Anderson | 229/16 R |
| 3,497,057 | 2/1970 | Traner et al. | 206/585 |
| 4,619,362 | 10/1986 | Crowe et al. | 206/326 |

FOREIGN PATENT DOCUMENTS

| | | | |
|---|---|---|---|
| 1097283 | 3/1981 | Canada | 206/326 |
| 79825 | 9/1955 | Denmark | 229/155 |

*Primary Examiner*—Stephen Marcus
*Assistant Examiner*—Gary S. Elkins
*Attorney, Agent, or Firm*—Lockwood Alex Fitzgibbon & Cummings

[57] ABSTRACT

The present invention relates to a novel cardboard container for packaging and securely holding a multi-piece place setting of dinnerware in such a manner so as to effectively reduce the amount of cardboard required for the container. The novel design of the container also permits the filled containers to be stacked in a nested, interfitted relationship, thus greatly increasing the number of sets of place settings of dinnerware which can be stored in a given area. The container is dimensioned such that each of the dinnerware items contained within the carton essentially contact the inner portions of the side, top and bottom walls of the carton to further securely hold the items of dinnerware within the carton and substantially eliminate any possibility of breakage of the dinnerware items contained within the carton.

6 Claims, 3 Drawing Sheets

DINNERWARE CARTON

BACKGROUND OF THE INVENTION

This invention relates in general to packaging of dinnerware and like fragile items, and more particularly, this invention relates to an efficient corrogated cardboard carton which is used to safely and securely package for shipment several items of fragile dinnerware, especially dinnerware made of ironstone or a similar type of ceramic material.

This invention is primarily concerned with packaging a multi-piece place setting of dinnerware, which multi-piece place setting is typically transported by a common carrier to the consumer or ultimate user of the dinnerware. Thus, it is important that the dinnerware articles packaged within the container are properly packaged and secured to prevent breakage of such articles during the shipping process.

In the past, multi-piece place settings of dinnerware were shipped in generally rectangular cartons of a uniform depth. Typically, each item of dinnerware was individually wrapped with foam sheeting and positioned within the cardboard container. For example, with respect to a three-piece a dinner plate would be positioned in the bottom of the container, a coffee cup saucer would be positioned on top of the dinnerplate, and a coffee cup would be positioned on top of the coffee cup saucer. Next, so-called bubble-packing, or like material, was inserted into the box to fill the larger voids within the box around the items of dinnerware placed in the box. The bubble-packing was inserted into the box to restrict the movement of the dinnerware items packaged in the box in order to reduce or eliminate breakage of the dinnerware items.

In other cases, a common method of packing known as "blister packing" was used in order to securely hold the articles within the container. However, the technique of blister packaging required specialized equipment to vacuum form a layer of thin polyethylene over each dinnerware item prior to insertion into the carton. This was an additional packaging step and greatly increased the cost of packaging dinnerware of this type.

Moreover, in the past, in order to insure that cartons of this type were properly sealed, the end flaps of the cartons were required to be secured by the use of adhesives. The use of adhesives in constructing cardboard packaging of this type is particularly undesirable, not only because external glue dispensing equipment must be utilized, but also the cartons themselves must be permitted to rest for a period of time after the application of adhesive in order for the adhesive to properly set. The required resting period for glued cartons of this type was an undesirable extra step which added additional cost to carton assembly by significantly increasing the amount of actual time necessary to properly package dinnerware items of this type.

Since multi-piece place settings of dinnerware are individually packaged in separate cardboard containers, a shipment of dinnerware to a purchaser would involve several cartons of multi-piece place settings of dinnerware. Thus, the size of the box, i.e., the volume that the container occupied, is significant for purposes of shipping products of this type. It is desirable to have as small a size box as possible while insuring that the dinnerware is properly packaged within the container to prevent breakage of such dinnerware during shipment.

The present invention solves the aforementioned problems presented by the prior art by providing a specially configured corrugated cardboard carton for packaging multi-piece dinnerware sets, including for example a dinnerware plate, coffee cup and a coffee cup saucer. In the carton configuration of the present invention, the dinnerplate is positioned in an upright position in the bottom of the carton and the cup and saucer dinnerware pieces are each positioned directly on the top surface of the larger dinnerplate, side by side. In order to efficiently accommodate such an arrangement of articles, the design of the carton of the present invention is a generally rectangular carton with an upper offset portion forming an "L-shaped design". The dinnerplate and saucer are positioned within the carton and the coffee cup is positioned in the offset or upper portion of the carton.

As a result of this design, the cartons are capable of being stacked in a nested relation on top of one another, such that two cartons will essentially interfit together to form a unitary rectangular shaped box occupying the volume of approximately one and one-half times the volume of the prior art rectangular containers, but instead containing two three piece dinnerware sets, as opposed to the one three-piece dinnerware set contained in the prior art container. This unique design not only is economical in that less cardboard material is used in forming the carton, but also results in a substantial savings in shipping costs due to the greatly reduced volume of space needed in connection with shipping. Further, it also reduces the amount of floor or shelf space necessary in a retail outlet to display cartons of this type.

The carton of the present invention can also be used to package four or five piece place settings of dinnerware. The additional pieces can be positioned on top of the coffee cup saucer.

Additionally, this invention includes a central locking tab and center support flap which not only holds the saucer in place within the carton, but also prevents the saucer (or other pieces positioned on the saucer) from directly contacting the coffee cup which further reduces the possibility of breakage of the products within the container. Further, when the dinnerware articles are packaged within the container, and the carton is fully assembled, it is not possible to reopen the carton itself without destroying the carton itself.

In view of the fact that the carton of the present invention does not use adhesives in connection with sealing the flaps of the carton, it is especially desirable that the carton cannot be opened without destroying the structural integrity of the carton. Typically, in retail stores merchandise is often left relatively unattended and customers are generally free to open packages, to view the contents of the package, and thus possibly subject the contents to breakage. This feature makes it relatively difficult for the carton to be opened in the store, but allows the customer to open the carton at home with the aid of a sharp knife.

Further, the carton is dimensioned such that each of the dinnerware items packaged within the carton are held in a rigid relation with respect to the carton, thus preventing movement and possible breakage during shipment. Additionally, the items in the carton are wrapped with a foam sheeting, or like material, which is placed between the dinner plate, cup and saucer. The foam sheeting, coupled with the dimensions of the carton corresponding to the various dimensions of the items of dinnerware, creates a tight fitting package such that upon rapid movement or shaking of the carton, no contact occurs between the various pieces of dinnerware packaged in the carton. This further minimizes the chance for breakage of the dinnerware items packaged within the carton.

SUMMARY OF THE INVENTION

It is, therefore, an object of the present invention to provide an improved container for shipping multi-piece place settings of dinnerware.

A more specific object of the present invention is to provide an improved shipping container which utilizes significantly less cardboard for constructing the container.

Another object of the present invention is to provide an improved shipping container which can securely and efficiently hold multi-piece place settings of dinnerware securely within the container so as to reduce or eliminate the possibility of breakage of the dinnerware articles packaged therein during shipping of such dinnerware items.

Still another object of the present invention is to provide a noval design configuration of such carton to reduce the total carton volume necessary to package multi-piece dinnerware items.

Another object of the present invention is to permit two cartons of the present invention to be inverted and interfitted in a nested relation to greatly reduce the total volume of space necessary to efficiently store and ship multi-piece dinnerware containers.

A still further object of the present invention is to dimension the cartons such that all items of dinnerware directly contact the interior surfaces of the carton walls to insure that such dinnerware items are held in a fixed relationship to prevent movement and breakage during shipping.

A further object of the present invention is to provide a number of locking tabs such that when the carton is fully assembled containing items of dinnerware, access to the contents of the carton is not available without destroying the structural integrity of the container.

Another object of the present invention is to eliminate the need for gluing the carton during the packaging operation.

To this end, the present invention relates to a novel cardboard container for packaging and securely holding a multi-piece place setting of dinnerware in such a manner so as to effectively reduce the amount of cardboard required for the container. The novel design of the container also permits the filled containers to be stacked in a nested, interfitted relationship, thus greatly increasing the number of sets of place settings of dinnerware which can be stored in a given area. The container is dimensioned such that each of the dinnerware items contained within the carton essentially contact the inner portions of the side, top and bottom walls of the carton to further securely hold the items of dinnerware within the carton and substantially eliminate any possibility of breakage of the dinnerware items contained within the carton.

The exact manner in which the aforesaid objects and advantages of the invention are achieved in practice will become more clearly apparent when reference is made to the accompanying description of the preferred embodiment of the invention which is set forth herein by way of example, and shown in the accompanying drawings wherein like reference numerals indicate corresponding parts throughout.

DETAILED DESCRIPTION OF THE PREFERRED EMBODIMENT OF THE INVENTION

Figure 1:
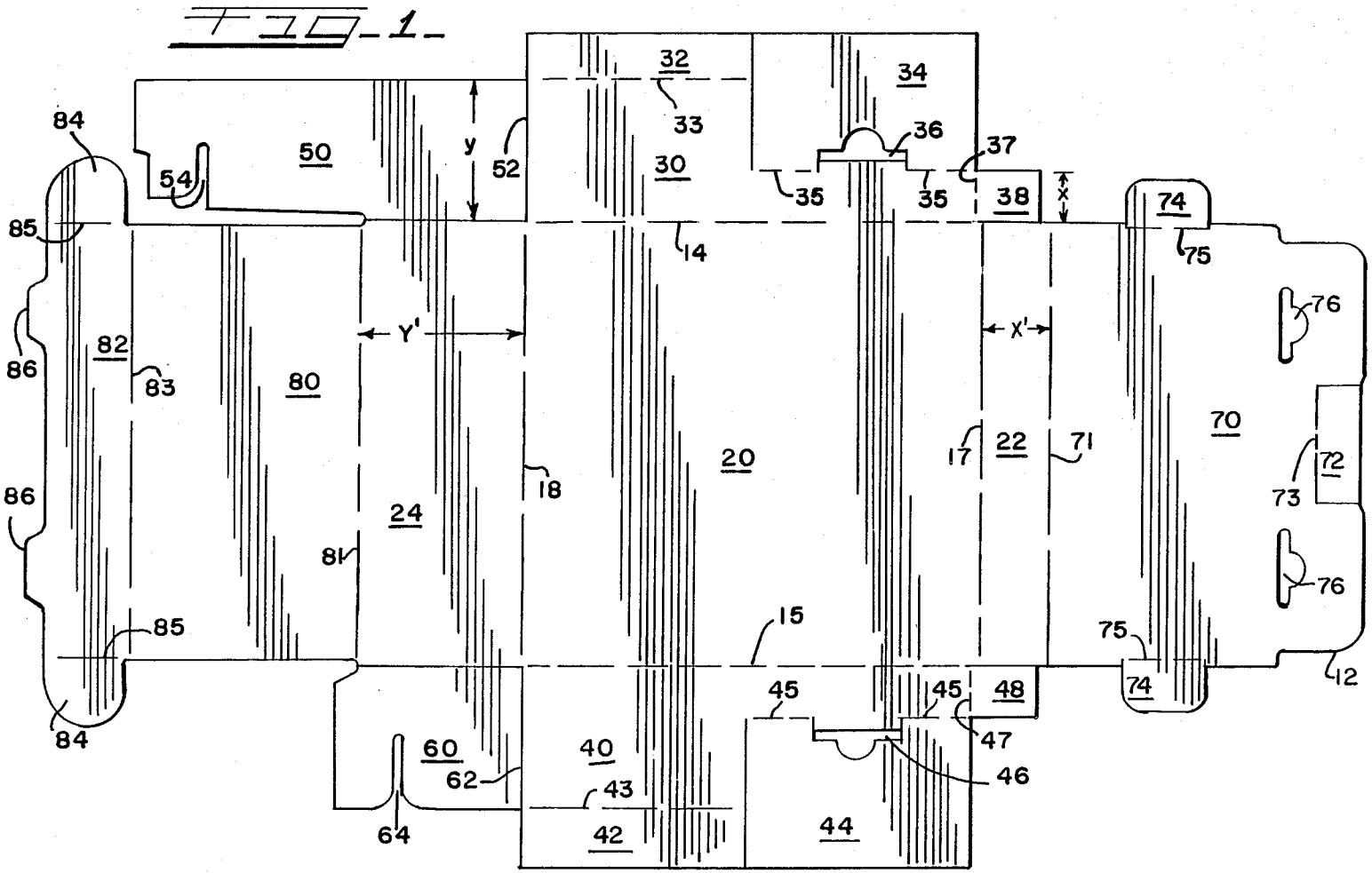
FIG. 1 is a plan view of the blank of the carton of the present invention which is cut and scored prior to forming the carton of the present invention.

Referring now in detail to the drawings, there is shown a corrugated cardboard carton 10 which is adapted to be used for packaging and shipping of multi-piece place settings of ironstone dinnerware products or like items. The carton 10 is fabricated from a single blank 12 of corrugated cardboard and cut and scored as shown in FIG. 1. It is understood that the container shown in the drawings was described and illustrated for purposes of setting forth the preferred embodiment of the invention so that the principles of the invention may be otherwise applied.

While reference in this preferred embodiment is to a carton for a three-piece place setting of dinnerware, it should be understood that the carton of the present invention can be utilized to package four or five piece place settings of dinnerware, without departing from the scope of the invention.

The carton 10 as illustrated in FIGS. 2–5 is shown in various stages of assembly. The carton is fabricated from the blank 12 shown in FIG. 1 with its uppermost face being the interior of the carton when the carton is completely assembled. The corrugated cardboard stock should be of sufficient stiffness and rigidity to not only protect the dinnerware packaged in the carton, but also provide structural support when several completed cartons are stacked on top of each other.

Referring now to FIG. 1, the blank 12 includes parallel longitudinally extending transversely spaced hinge-forming fold lines 14, 15 and parallel transversely extending longitudinally spaced hinge forming fold lines 17, 18. The fold lines 14, 15 17, 18, define a bottom wall forming center panel 20 upon which a item of dinnerware, such as a dinner plate P (shown in FIG. 5) can be positioned for packaging. A front end wall panel 22 and a back end wall panel 24 are hingedly connected to the bottom wall panel 20 along fold lines 17, 18, respectively. End wall panels 22 and 24 are adapted to be folded into a position generally perpendicular to the bottom wall forming panel 20. A pair of sidewall panels, 30 and 40, are hingedly connected to the bottom wall forming panel 20 along fold lines 14, 15, respectively. The sidewall panels 30 and 40 are adapted to be folded to a plane which is perpendicular to the bottom wall 20 the end walls 22, 24.

Each sidewall panel 30, 40 includes a pair of interior upper and lower top wall forming flaps 32, 34 and 42, 44, respectively. The interior upper top wall forming flaps 32, 42 are hingedly connected to the side wall panels 30, 40 along fold lines 33, 43 respectively. When the carton is assembled, the top interior wall flaps 32, 42 are adapted to be located in a plane generally parallel to the bottom wall panel 20 and perpendicular to the sidewall 30, 40 panels. The interior lower top wall forming flaps 34, 44 are hingedly connected to the sidewall panels 30, 40 along a pair of fold lines 35, 45, respectively, and when assembled, lie in a plane substantially parallel to the plane of the bottom wall forming panel 20. The lower top wall flaps 34, 44 are adapted to directly overlie the dinnerware positioned within the carton.

The sidewall panels 30 and 40, further include reinforcement tabs 38, 48 which are hingedly connected to the sidewall panels along fold line 37, 47. When the carton is assembled, the tabs 38, 48 are positioned in a plane parallel to and contacting the outboard ends of the interior of the front end wall 22 to provide structural reinforcement for the carton. The transverse dimension X of the tabs 38, 48, is substantially equal to the longitudinal width X' of the end wall panel 22, thereby providing the necessary structural support for the end wall panel 22.

The lower top wall flaps 34, 44 include sidewall locking apertures 36, 46, respectively, which apertures are adapted to receive a locking tab to support and position the sidewall panels 30, 40 in a perpendicular position relative to the bottom wall panel 20.

The sidewall panels 30, 40 further include back end wall reinforcing panels 50, 60 which panels are hingedly connected along fold lines 52, 62 to the sidewall panels 30 and 40 on the end opposite the tabs 38, 48. Back wall panels 50, 60 are adapted to be interfitted together by mutually engageable slots 54, 64 such that when the carton is assembled, the slot 54 overlies and engages the slot 64. When the carton is assembled, the inter-connected backwall reinforcing panels 50, 60 lie in a plane substantially perpendicular to the bottom wall panel and are immediately adjacent to and contact the inner wall of the back wall panel 24. The reinforcing panel 50 has a transverse dimension Y which is substantially equal to the longitudinal width Y' of back wall panel 24. The connected back reinforcing panels 50, 60 together with the bottom wall 20 and the side walls 30,40 provide the necessary structural integrity to form the basic interior configuration of the carton.

The carton 10 further includes a lower top wall forming panel 70 and an upper top wall forming panel 80. The top wall forming panels 70, 80 are hingedly connected along fold lines 71 and 81 to the front and back end walls 22 and 24, respectively. When the carton is assembled, the top wall forming panels 70, 80 lie in a plane substantially parallel to the bottom wall forming panel 20. The top wall forming panels 70 and 80 are offset, but lie in parallel planes.

The lower top wall panel 70 has a pair of locking flaps 74, which flaps are hingedly connected to the transverse outboard edges of the blank 12, along an offset fold line 75. The locking tabs 74 are adapted to be inserted into the sidewall locking apertures 36, 46 when the carton is assembled. Further, the lower top wall panel 70 includes a central locking tab 72 hingedly connected to the upper top wall forming panel 70 along hinged line 73. When the carton is assembled, locking tab 72 is positioned in a plane substantially perpendicular to the top wall forming panel in such a manner that the tab 72 will contact the outer edge of the saucer S (shown in FIG. 4) packaged within the carton of the present invention.

While the outer perimeter edges of the dinner plate P will contact the end wall 22, the sidewalls 30, 40 and the back wall reinforcement panels 50, 60, the saucer S will be positioned directly on the dinnerplate and its edges will contact the end wall 22 and the locking tab 72. The locking tab 72 holds the saucer S in position and restricts its movement within the carton during exterior movements of the assembled packaged carton.

The lower top panel 70 also includes a pair of locking apertures 76 which are adapted to receive locking tongues to secure the top wall forming panel 70 in position. When positioned in use, the top wall forming panel 70 overlies the interior lower top wall forming panels 34, 44 and the saucer S.

The upper top wall forming panel 80 includes a central end panel 82 hingedly connected to the top wall forming panel 80 along fold line 83. The central end panel 82 includes a pair of locking flaps 84 which are adapted to secure the upper top wall panel 80. The central end wall panel 82 also includes a pair of locking tongues 86 which are adapted to mate with the locking apertures 76 on the lower top wall forming panel 70 and securely hold the lower top wall panel 70. When the carton is assembled, the upper top wall forming panel 80 lies in a plane substantially parallel to the plane of the bottom wall forming panel 20. The center end wall panel 82 lies in a plane which is perpendicular to the upper top wall panel 80 and parallel to the end wall panels 22, 24. The locking flaps 84 are adapted to be folded along fold lines 85 to a position substantially perpendicualr to the center end wall panel 82. When the carton is assembled, the flaps 84 lie adjacent to the upper inner portions of the sidewalls 30, 40 and the top wall forming panel 80 overlies and contacts the interior upper top wall panels 32, 42.

Referring now to FIGS. 2 through 5, there is shown the carton 10 of the present invention in progressive stages of assembly with portions broken away and certain of the drawings particularly illustrate various specialized features of the preferred embodiment previously disclosed herein.

Figure 2:
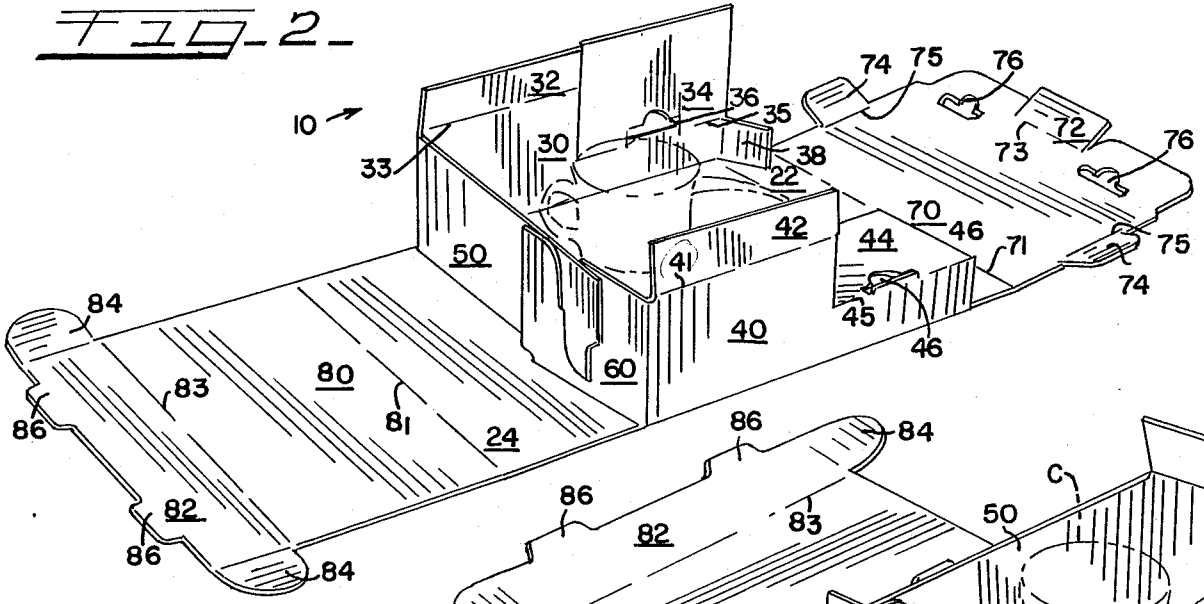
FIG. 2 is a perspective view of the carton of the present invention in a partially assembled form.

Referring now to FIG. 2 there is shown the dinnerplate P positioned directly on the innerface of the bottom wall forming panel 20, the coffee cup saucer S positioned toward the front end wall 22 and the coffee cup C is positioned toward the back end wall 24. The sidewall panels 30 and 40 have been folded to an upright perpendicular position along fold line 14, 15 and the back wall reinforcing panels 50, 60 have been folded along fold lines 52, 62. The slots 54, 64 on the back wall reinforcing panel 50, 60 are engaged to form an inside back wall for the carton to provide the basic interior structural integrity for the carton.

The reinforcement tabs 38, 48 are folded along fold lines 37, 47 and lie in a plane substantially perpendicular to the sidewall panels 30, 40 and provide structural support and reinforcement for the front end of the carton. The interior lower top wall forming panel portions 34, 44 are folded along fold lines 35, 45 to a position substantially overlying the saucer S packaged within the carton.

Figure 3:
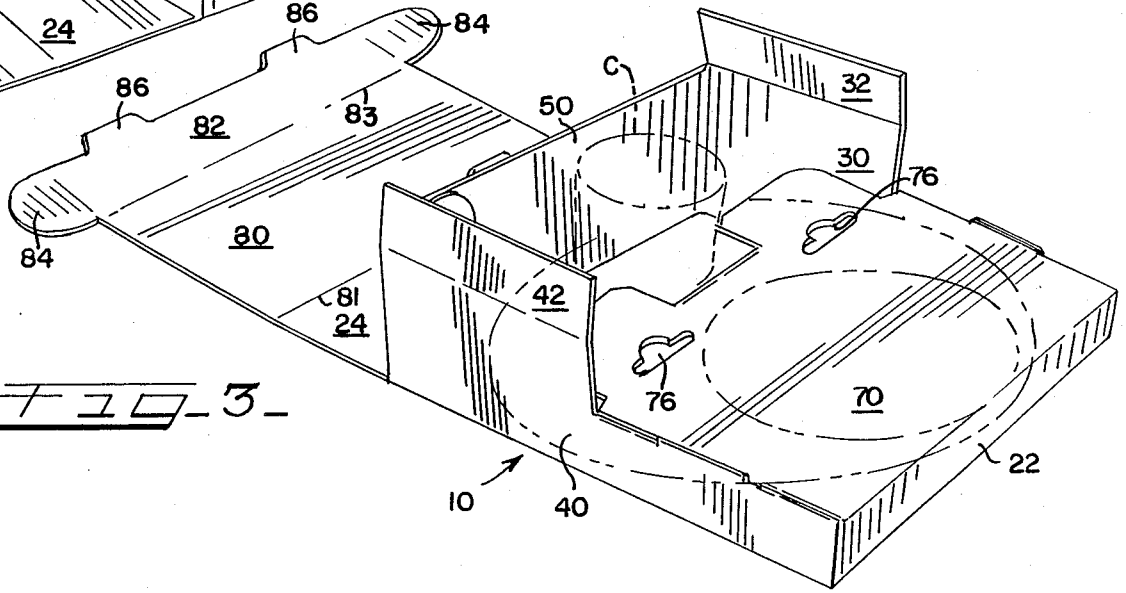
FIG. 3 is a perspective view of the carton of the present invention showing the carton in a further assembled form than the view shown in FIG. 2.

Referring now to FIG. 3, the top wall forming panel 70 and front end wall panel 22 are folded respectively along fold lines 71, 17 such that the end wall panel 22 is in a plane substantially perpendicular to the bottom wall forming panel 20 and the lower top wall panel 70 overlies the saucer S. The locking tabs 74 are folded along lines 75 and inserted into side wall apertures 36, 46 to securely hold the lower top wall forming panel 70 in a position overlying the inner top wall forming panels 34, 44.

Figure 4:
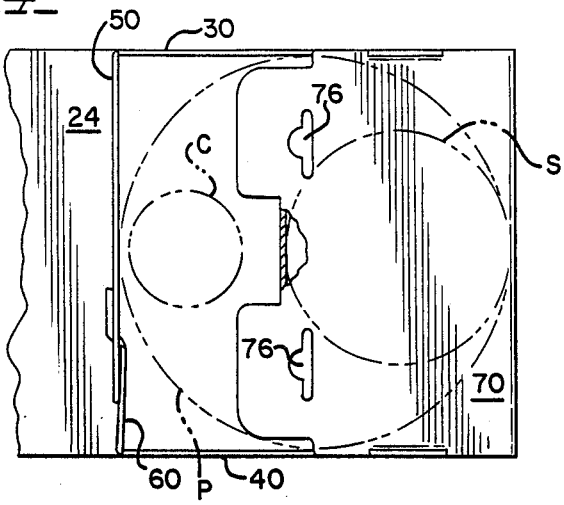
FIG. 4 is a partial top plan view of the carton of the present with portions broken away showing the carton construction prior to the final step in assembly.

As shown in FIG. 4, the central locking tab 72 is folded along fold line 73 to contact an outer edge of the saucer and securely hold the saucer between the central locking tab 72 and the end wall 22 to prevents the saucer from moving within the container.

The coffee cup C is then positioned within the container as shown in FIG. 3. The interior upper top wall panels 32, 42 are folded down to a position in a plane substantially parallel to the plane of the top wall forming panel 70.

The back end wall 24, the upper top wall forming panel 80 and the central end panel 82 are then folded along fold lines 18, 81, 83 respectively, such that the back end panel 24 is in a position substantially perpendicular to the bottom wall panel 20. The top wall panel 80 is then in a position substantially parallel to the lower top wall forming panel 70. The central end wall panel 82 is in a position substantially perpendicular to both the upper top wall forming panel 80 and the lower top wall forming panel 70. The locking flaps 84 are folded along fold lines 85 and folded into a position adjacent to the interiors of the sidewalls 30, 40. The locking tongues 86 on the end wall panel 82 fit securely within the apertures 76 on the lower wall panel 70. The combination of the locking flaps 84 and the locking tongues 86 inserted into the locking apertures 76 securely holds the upper top wall forming panel 80 in position.

Figure 5:
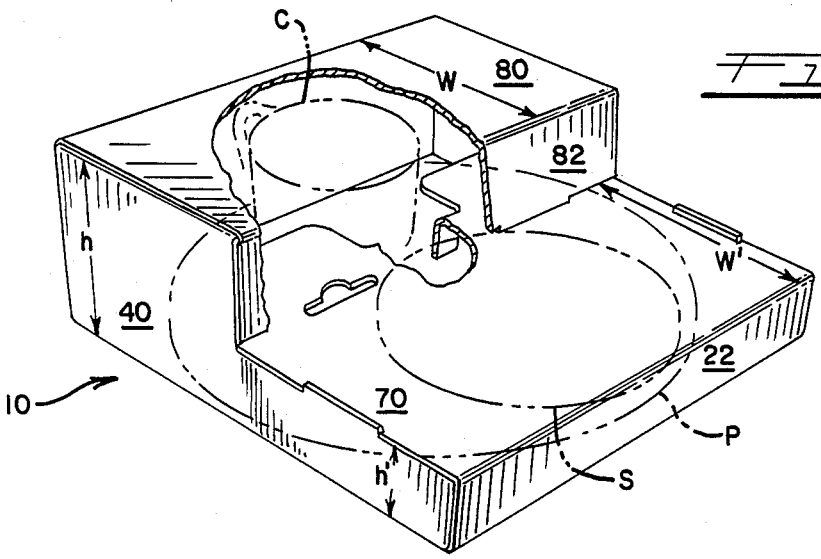
FIG. 5 is a top perspective view of a carton of the present invention fully assembled with portions broken away.

Referring now to FIG. 5, there is shown the completed form of the carton with a three-piece place setting of dinnerware. Portions of the carton are broken away to show the internal components of the carton. The top wall forming panel 80 overlies and contacts the cup C as shown in FIG. 5. The overall height of the carton at H in FIG. 5 is substantially equal to the thickness of the dinnerplate P, plus the overall height of the coffee cup C. The height of the carton at H′ is substantially equal to the distance from the top edge of the saucer S to the bottom surface of the dinnerplate P. In this way, the carton is dimensioned so that the perimeter and upper edges of each of the dinnerware items directly contact the interior walls of the carton to insure that the dinnerware is held firmly within the carton and not susceptible to movement within the carton.

Figure 6:
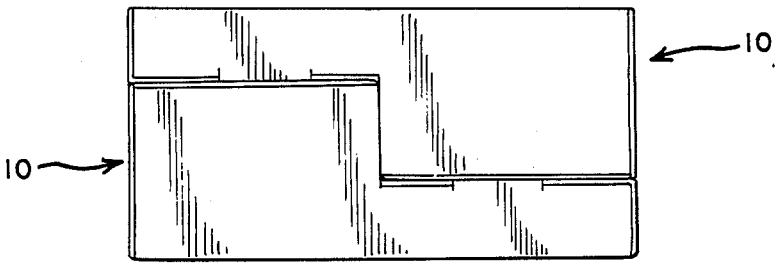
FIG. 6 is a side view of the two cartons of the present invention interfitted in a nested relationship.

The longitudinal dimension W of the upper top wall forming panel 80 and the longitudinal dimension W′ of the lower top wall forming panel 70 are substantially equal and the height h of the carton is greater than the height h′ to permit the cartons to be inverted and stacked in a nested relationship (shown in FIG. 6), thereby reducing the amount of space necessary to store numerous cartons containing the dinnerware items.

Finally, when the carton 10 is completely assembled and the respective locking flaps 74, 84 and locking tongues 86 are all properly positioned within their locking apertures 36, 46 and 76, the carton 10 cannot be opened without destroying the structural integrity of the carton. In order to open the carton, it is necessary to physically tear a portions of the carton 10 to gain access to the contents. This feature further enhances the reliability of the package in that it is not only difficult to open the package, but the contents are snugly and securely positioned within the carton and thereby minimize the movement of the products and virtually eliminates the possiblity of breakage of the dinnerware items during shipping of the dinnerware.

While the invention described before is for the preferred embodiment, it will be understood by those skilled in the art that various changes may be made and equivalents may be substituted for thereof without departing from the spirit of the invention or the scope of the appended claims. In addition, modification to the specifics will appear to those skilled in the art. Therefore, it is intended that the invention will not be limited to the particular embodiment disclosed as the best mode for carrying out the invention, that the invention will include all embodiments falling within the scope of the appended claims.

I claim:

1. A container for packaging articles of dinnerware or like items, which container is formed from a blank of foldable cardboard material which is cut and scored to provide a generally rectangular bottom wall panel, oppositely disposed side wall panels hinged to said bottom wall panel, oppositely disposed end wall panels hinged to said bottom wall panel and upper and lower top wall panels each hinged to one of said end wall panels, said end wall panels and said side wall panels lie in planes substantially perpendicular to said bottom wall panel and said top wall panels lie in planes substantially parallel to the plane of said bottom wall panel, an interior lower top wall flap hingedly connected to each said side wall panel and underlying said lower top wall panel, said interior lower top wall flaps including a locking aperture having a locking tab positioned therein, said locking tab being hingedly connected to an outboard edge of said lower top wall panel to secure said lower top wall panel, said lower top wall panel including a central locking tab hingedly connected to said lower top wall panel for contacting an outer edge of one dinnerware article packaged within said container to prevent movement of the article within the container, said upper top wall panel further including a central end panel, said central end panel including a pair of locking tongues which are received in a second pair of locking apertures in said lower top wall panel to secure the upper top wall panel in position, reinforcing flap hingedly connected to one end of each said side wall panel, said reinforcement flaps being connected to each other to provide structural integrity for said container, the interior of said container being dimensioned so that portions of said bottom wall panel, said side wall panels, one of said end wall panels, said interconnected reinforcement flaps, said upper top wall panel and said lower interior top wall panels can contact portions of the dinnerware articles packaged within said container to prevent movement of such articles within said container, said side wall panels being generally L-shaped such that the dimension of one end of each of said sidewall panels is greater than the dimension of the other end of said side wall panels, and the transverse dimension of said top wall panel being equal to the transverse dimension of said lower top wall panel such that a plurality of said containers can be interfitted in a nested relationship.

2. A container for packaging articles of dinnerware or like items, which container is formed from a blank of foldable cardboard material which is cut and scored to provide a generally rectangular bottom wall panel, oppositely disposed side wall panels hinged to said bottom wall panel, oppositely disposed end wall panels hinged to said bottom wall panel and or upper and a lower top wall panel each hinged to one of said end wall panels, said upper and lower top panels being spaced apart, said end wall panels and said side wall panels lie in planes substantially perpendicular to said bottom wall panel and said top wall panels lie in planes substantially parallel to the plane of said bottom wall panel, each of said side wall panels including an interior lower top wall flap hingedly connected to said side wall panel and underlying said lower top wall panel, said interior lower top wall flaps including a locking aperture having a locking tab positioned therein said locking tab being hinedly connected to an outboard edge of said lower top wall panel to secure said lower top wall panel in position, said lower top wall panel including a central locking tab hingedly connected to said lower top wall panel for contacting an outer edge of one dinnerware article packaged within said container to prevent movement of the article within the container, said upper top wall panel further including a central end panel hinged thereto; said central end panel extending between said side wall panels and lying in a plane parallel to and between the planes of said end wall panels, said central end panel including a pair of locking tongues which are received in a second pair of locking apertures in said lower top wall panel to secure the upper top wall panel in position, each of said side wall panels further including a reinforcing flap hingedly connected to one end of said side wall panel, said reinforcement flaps including slots for interconnecting said flaps to each other to provide structural integrity for said container, and the interior of said container being dimensioned so that portions of said bottom wall panel, said side wall panels, one of said end wall panels, said interconnected reinforcement flaps, said upper top wall panel and said lower interior top wall panels can contact portions of the dinnerware articles packaged within said container to prevent movement of such articles within said container.

3. A container as defined in claim 2 wherein each of said sidewall panels includes a reinforcement tab hingedly connected thereto.

4. A container as defined in claim 2 wherein said central end wall panel further includes a pair of locking flaps hingedly connected thereto and lying along said side wall panels to further secure said upper top wall panel, said central panel and one of said end wall panels.

5. A container as defined by claim 2 wherein said side wall panels each include interior top wall flaps underlying said top wall panel.

6. A cut and scored blank of foldable cardboard material for fabricating a container for packaging articles of dinnerware and the like being generally rectangular in shape and being cut and scored to provide a bottom wall forming panel which is defined by a pair of oppositely disposed, generally rectangular side wall forming panels and a pair of oppositely disposed generally rectangular end wall forming panels, said end wall forming panels being hinged respectively to a first and a second top wall forming panel, said first top wall forming panel including a central end panel hingedly connected thereto, each of said side wall forming panels further including inner top wall flaps which are adapted to overlie certain of the articles packaged within said container, each of said inner top wall flaps including a locking aperture adapted to receive a locking tab, said locking tab being hingedly connected to said second top wall forming panel, and said central end panel including a pair of locking tongues adapted to be positioned in a pair of locking apertures on said second top wall forming panel, said second top wall forming panel further including a central locking tab hingedly connected thereto to restrain at least one item of dinnerware from movement within the container; said side wall forming panels each including a reinforcement panel positioned on back of said side wall forming panel and a reinforcement tab, said reinforcement panels on back of said sidewall forming panels including a slot such that said reinforcement panels can be interconnected to each other.

* * * * *